US011217921B2

(12) United States Patent
Phillips et al.

(10) Patent No.: US 11,217,921 B2
(45) Date of Patent: Jan. 4, 2022

(54) ELECTRICAL CONNECTOR HAVING A GROUND BUS WIRE

(71) Applicant: TE Connectivity Services GmbH, Schaffhausen (CH)

(72) Inventors: Michael John Phillips, Camp Hill, PA (US); Randall Robert Henry, Lebanon, PA (US); Bruce Allen Champion, Camp Hill, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/877,719

(22) Filed: May 19, 2020

(65) Prior Publication Data

US 2021/0367364 A1 Nov. 25, 2021

(51) Int. Cl.

| | |
|---|---|
| ***H01R 12/73*** | (2011.01) |
| ***H01R 12/71*** | (2011.01) |
| ***H01R 24/62*** | (2011.01) |
| *H01R 12/00* | (2006.01) |
| *H01R 12/72* | (2011.01) |
| *H01R 43/02* | (2006.01) |
| *H01R 25/16* | (2006.01) |
| *H01R 9/24* | (2006.01) |

(Continued)

(52) U.S. Cl.

CPC ..... *H01R 12/73* (2013.01); *H01R 12/712* (2013.01); *H01R 24/62* (2013.01); *H01R 9/0512* (2013.01); *H01R 9/2483* (2013.01); *H01R 9/2691* (2013.01); *H01R 12/00* (2013.01); *H01R 12/72* (2013.01); *H01R 12/724* (2013.01); *H01R 12/775* (2013.01); *H01R 13/6471* (2013.01); *H01R 13/6485* (2013.01); *H01R 13/655* (2013.01); *H01R 25/16* (2013.01); *H01R 43/0228* (2013.01)

(58) Field of Classification Search

CPC ..... H01R 9/0512; H01R 12/775; H01R 13/6471; H01R 13/655; H01R 13/6485; H01R 12/724; H01R 25/16; H01R 43/0228; H01R 9/2483; H01R 9/2691; H01R 12/73; H01R 24/62; H01R 12/712; H01R 12/00; H01R 12/72

USPC ..... 439/98, 99

See application file for complete search history.

(56) References Cited

U.S. PATENT DOCUMENTS 9,559,465 B2 1/2017 Phillips et al.
9,972,945 B1 * 5/2018 Huang ..... H01R 24/60

(Continued)

*Primary Examiner* — Abdullah A Riyami
*Assistant Examiner* — Justin M Kratt

(57) ABSTRACT

A contact assembly for an electrical connector includes a contact positioner having contact support walls holding a contact array. The contact array includes signal contacts and ground contacts interspersed with the signal contacts. The signal contacts include mating ends configured to be mated with a mating electrical connector and mounting ends configured to be terminated to a host circuit board. The signal contacts include transition portions between the mating ends and the mounting ends. The ground contacts include mating ends, mounting ends, and transition portions between the mating ends and the mounting ends. The contract assembly includes a ground bus wire extending transversely across the contact array. The ground bus wire is electrically connected to each of the ground contacts. The ground bus wire is electrically isolated from each of the signal contacts.

20 Claims, 6 Drawing Sheets

(51) Int. Cl.

| | |
|---|---|
| *H01R 9/26* | (2006.01) |
| *H01R 12/77* | (2011.01) |
| *H01R 13/648* | (2006.01) |
| *H01R 13/655* | (2006.01) |
| *H01R 9/05* | (2006.01) |
| *H01R 13/6471* | (2011.01) |

(56) References Cited

U.S. PATENT DOCUMENTS

| | | | | |
|---|---|---|---|---|
| 10,938,162 | B2 * | 3/2021 | Lin | H01R 13/6471 |
| 2017/0018880 | A1 * | 1/2017 | Phillips | H01R 12/727 |

* cited by examiner

ELECTRICAL CONNECTOR HAVING A GROUND BUS WIRE

BACKGROUND OF THE INVENTION

The subject matter herein relates generally to electrical connectors of communication systems.

Some communication systems utilize communication connectors, such as card edge connectors to interconnect various components of the system for data communication. Some known communication systems use pluggable modules, such as I/O modules or circuit cards, which are electrically connected to the card edge connectors. The pluggable modules have module circuit cards having card edges that are mated with the card edge connectors during the mating operation. Each card edge connector typically has an upper row of contacts and a lower row of contact for mating with the corresponding circuit board. There is a need for electrical connectors and circuit boards of communication systems to have greater contact density and/or data throughput. However, as contact density and data throughput are increased, electrical performance is negatively affected. For instance, the signal lines suffer from cross-talk.

Known electrical connectors include a ground shielding structure to provide electrical shielding for the signal lines. For example, ground shields may be connected to the ground contacts to provide electrical shielding. Such ground shields are typically soldered or welded to the ground contacts. The ground shields are stamped and formed parts and increase manufacturing costs and assembly costs of the electrical connector.

A need remains for a reliable electrical connector.

BRIEF DESCRIPTION OF THE INVENTION

In one embodiment, a contact assembly for an electrical connector is provided. The contract assembly includes a contact positioner having contact support walls. The contact assembly includes a contact array including signal contacts and ground contacts interspersed with the signal contacts. The signal contacts and the ground contacts are held by the support walls of the contact positioner. The signal contacts include mating ends configured to be mated with a mating electrical connector and mounting ends configured to be terminated to a host circuit board. The signal contacts include transition portions between the mating ends and the mounting ends. The ground contacts include mating ends configured to be mated with the mating electrical connector and mounting ends configured to be terminated to the host circuit board. The ground contacts include transition portions between the mating ends and the mounting ends. The contract assembly includes a ground bus wire extending transversely across the contact array. The ground bus wire is electrically connected to each of the ground contacts. The ground bus wire is electrically isolated from each of the signal contacts.

In another embodiment, an electrical connector for mating with a pluggable module is provided. The electrical connector includes a housing including a top and a bottom. The housing has a front and a rear. The housing has a first side and a second side. The bottom is configured to be mounted to a host circuit board. The housing includes a cavity and a housing card slot open to the cavity at the front of the housing. The housing card slot is configured to receive a card edge of a module circuit card of the pluggable module. The electrical connector includes a contact assembly received in the cavity. The contact assembly has a contact positioner having contact support walls supporting a contact array including signal contacts and ground contacts interspersed with the signal contacts. The signal contacts include mating ends configured to be mated with the module circuit card of the pluggable module and mounting ends configured to be terminated to the host circuit board. The signal contacts include transition portions between the mating ends and the mounting ends. The ground contacts include mating ends configured to be mated with the module circuit card of the pluggable module and mounting ends configured to be terminated to the host circuit board. The ground contacts include transition portions between the mating ends and the mounting ends. The contact assembly includes a ground bus wire extending transversely across the contact array. The ground bus wire is electrically connected to each of the ground contacts. The ground bus wire is electrically isolated from each of the signal contacts.

In a further embodiment, a communication system is provided. The communication system includes a host circuit board including board contacts. The communication system includes a pluggable module including a module circuit card. The module circuit card has a card edge. The module circuit card includes card contacts proximate to the card edge. The communication system includes an electrical connector mounted to the host circuit board. The electrical connector is electrically connected to the pluggable module to connect the pluggable module and the host circuit board. The electrical connector includes a housing having a cavity and a contact assembly received in the cavity. The housing has a housing card slot receiving the card edge of the module circuit card of the pluggable module. The contact assembly has a contact positioner supporting a contact array including signal contacts and ground contacts interspersed with the signal contacts. The signal contacts includes mating ends mated with the card contacts of the module circuit card and mounting ends terminated to the host circuit board. The signal contacts includes transition portions between the mating ends and the mounting ends. The ground contacts include mating ends mated with the card contacts of the module circuit card and mounting ends terminated to the host circuit board. The ground contacts include transition portions between the mating ends and the mounting ends. The contact assembly includes a ground bus wire extending transversely across the contact array. The ground bus wire is electrically connected to each of the ground contacts. The ground bus wire is electrically isolated from each of the signal contacts.

DETAILED DESCRIPTION OF THE INVENTION

Figure 1:
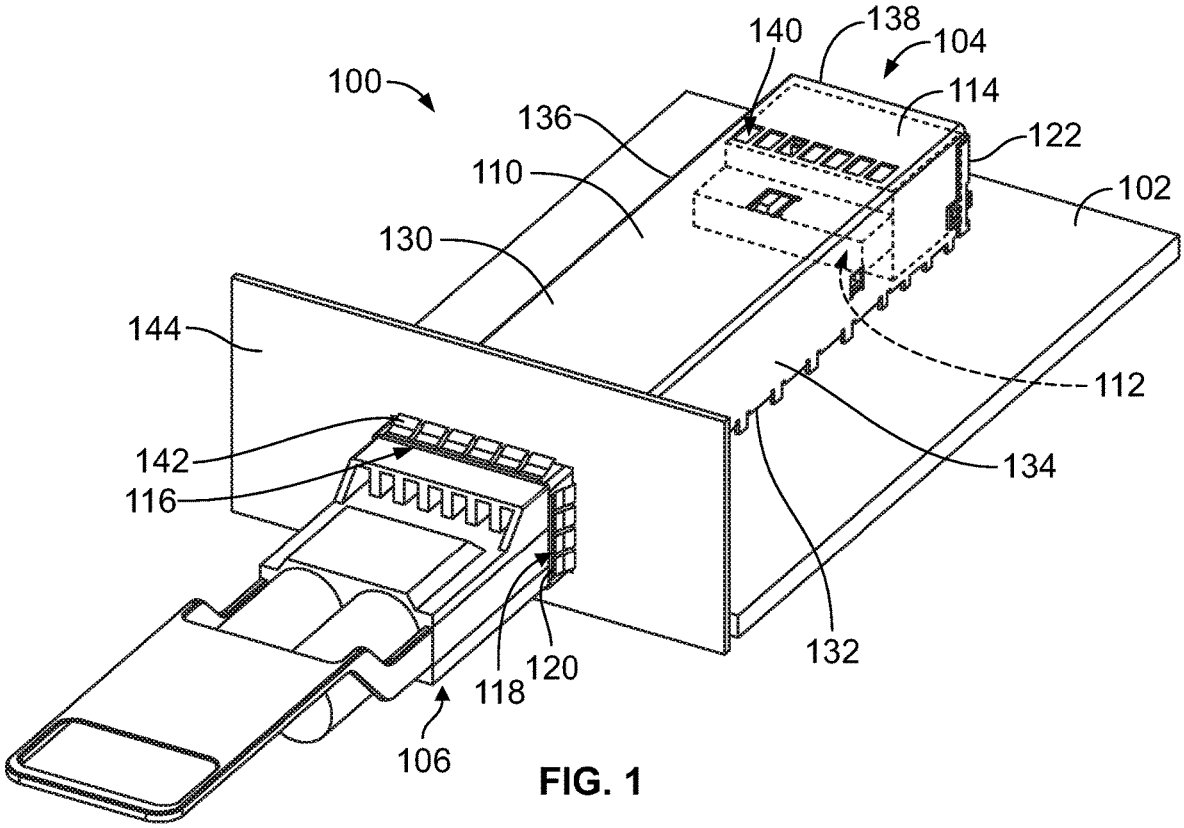
FIG. 1 is a front perspective view of a communication system formed in accordance with an exemplary embodiment.
Figure 2:
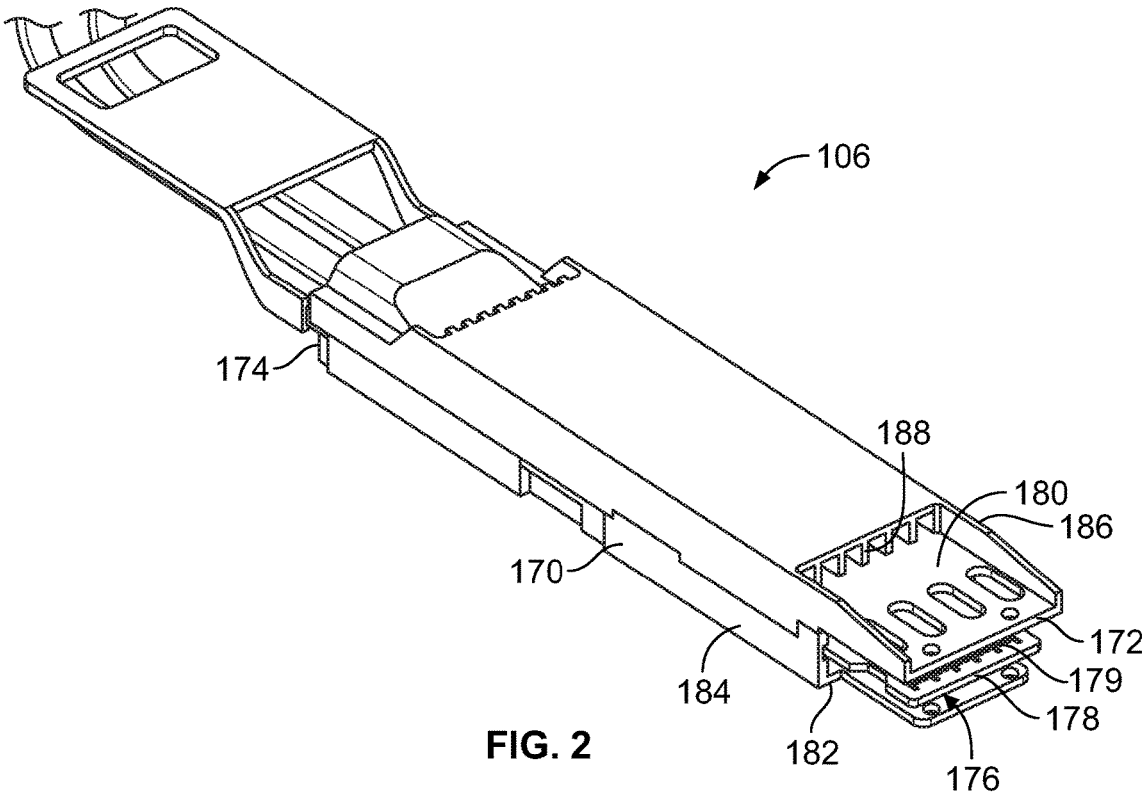
FIG. 2 is a rear perspective view of the pluggable module in accordance with an exemplary embodiment.

FIG. 1 is a front perspective view of a communication system 100 formed in accordance with an exemplary embodiment. The communication system includes a host circuit board 102 and a receptacle connector assembly 104 mounted to the host circuit board 102. A mating electrical connector 106 is configured to be electrically connected to the receptacle connector assembly 104. The mating electrical connector 106 is electrically connected to the host circuit board 102 through the receptacle connector assembly 104. In various embodiments, the mating electrical connector 106 may be a pluggable module, such as a transceiver module or I/O module, and may be referred to hereinafter as pluggable module 106. The pluggable module 106 is shown in FIG. 2; however, other types of electrical connectors may be used in alternative embodiments.

In an exemplary embodiment, the receptacle connector assembly 104 includes a receptacle cage 110 and an electrical connector 112 (shown with phantom lines) adjacent the receptacle cage 110. The mating electrical connector 106 is configured to be mated with the electrical connector 112. In various embodiments, the electrical connector 112 may be a card edge connector and may be referred to hereinafter as a card edge connector 112. In the illustrated embodiment, the card edge connector 112 is received in the receptacle cage 110. In other various embodiments, the card edge connector 112 may be located rearward of the receptacle cage 110. In various embodiments, the receptacle cage 110 is enclosed and provides electrical shielding for the card edge connector 112. The pluggable modules 106 are loaded into the receptacle cage 110 and are at least partially surrounded by the receptacle cage 110. In an exemplary embodiment, the receptacle cage 110 is a shielding, stamped and formed cage member that includes a plurality of shielding walls 114 that define one or more module channels for receipt of corresponding pluggable modules 106. The shielding walls 114 of the receptacle cage 110 provide electrical shielding around the card edge connector 112 and the pluggable module 106, such as around the mating interface between the card edge connector 112 and the pluggable module 106. In other embodiments, the receptacle cage 110 may be open between frame members to provide cooling airflow for the pluggable modules 106 with the frame members of the receptacle cage 110 defining guide tracks for guiding loading of the pluggable modules 106 into the receptacle cage 110.

In other various embodiments, the receptacle connector assembly 104 may be provided without the receptacle cage 110, rather only including the electrical connector 112. In the illustrated embodiment, the card edge connector 112 is oriented for horizontal mating (for example, parallel to the host circuit board 102). In other various embodiments, the card edge connector 112 is oriented for vertical mating (for example, perpendicular to the host circuit board 102).

In the illustrated embodiment, the receptacle cage 110 is a single port receptacle cage configured to receive a single pluggable module 106. In other various embodiments, the receptacle cage 110 may be a ganged cage member having a plurality of ports ganged together in a single row and/or a stacked cage member having multiple ports stacked as an upper port and a lower port. The receptacle cage 110 includes a module channel 116 having a module port 118 open to the module channel 116. The module channel 116 receives the pluggable module 106 through the module port 118. In an exemplary embodiment, the receptacle cage 110 extends between a front end 120 and a rear end 122. The module port 118 is provided at the front end 120. Any number of module channels 116 may be provided in various embodiments arranged in a single column or in multiple columns (for example, 2×2, 3×2, 4×2, 4×3, 4×1, 2×1, and the like). Optionally, multiple card edge connectors 112 may be arranged within the receptacle cage 110, such as when multiple rows and/or columns of module channels 116 are provided.

In an exemplary embodiment, the walls 114 of the receptacle cage 110 include a top wall 130, a bottom wall 132, a first side wall 134 and a second side wall 136 extending from the top wall 130. The bottom wall 132 may rest on the host circuit board 102. In other various embodiments, the receptacle cage 110 may be provided without the bottom wall 132. Optionally, the walls 114 of the receptacle cage 110 may include a rear wall 138 at the rear end 122. The walls 114 define a cavity 140. For example, the cavity 140 may be defined by the top wall 130, the bottom wall 132, the side walls 134, 136 and the rear wall 138. The cavity 140 includes the module channel 116. In various embodiments, the cavity 140 receives the card edge connector 112, such as at the rear end 122. Other walls 114 may separate or divide the cavity 140 into additional module channels 116, such as in embodiments using ganged and/or stacked receptacle cages. For example, the walls 114 may include one or more vertical divider walls between ganged module channels 116. In various embodiments, the walls 114 may include a separator panel between stacked upper and lower module channels 116. The separator panel may include an upper panel and a lower panel that form a space between the upper and lower module channels 116, such as for airflow, for a heat sink, for routing light pipes, or for other purposes.

In an exemplary embodiment, the receptacle cage 110 may include one or more gaskets 142 at the front end 120 for providing electrical shielding for the module channels 116. For example, the gaskets 142 may be provided at the port 118 to electrically connect with the pluggable modules 106 received in the module channel 116. Optionally, the pluggable module 106 may include a gasket that engages the receptacle cage 110 rather than the receptacle cage 110 having a gasket that engages the pluggable module 106. In an exemplary embodiment, the gaskets 142 may be provided around the exterior of the receptacle cage 110 for interfacing with a panel 144, such as when the front end 120 of the receptacle cage 110 extends through a cutout in the panel. The gaskets 142 may include spring fingers or other deflectable features that are configured to be spring biased against the panel to create an electrical connection with the panel.

Optionally, the receptacle connector assembly 104 may include one or more heat sinks (not shown) for dissipating heat from the pluggable modules 106. For example, the heat sink may be coupled to the top wall 130 for engaging the pluggable module 106 received in the module channel 116. The heat sink may extend through an opening in the top wall 130 to directly engage the pluggable module 106. Other types of heat sinks may be provided in alternative embodiments.

In an exemplary embodiment, the card edge connector 112 is received in the cavity 140, such as proximate to the rear wall 138. However, in alternative embodiments, the card edge connector 112 may be located behind the rear wall 138 exterior of the receptacle cage 110 and extend into the cavity 140 to interface with the pluggable module(s) 106. In an exemplary embodiment, a single card edge connector 112 is provided. In alternative embodiments, the communication system 100 may include multiple card edge connectors 112 (for example, for stacked and/or ganged receptacle cages) for mating with corresponding pluggable modules 106.

FIG. 2 is a rear perspective view of the pluggable module 106 in accordance with an exemplary embodiment. The pluggable module 106 has a pluggable body 170, which may be defined by one or more shells. The pluggable body 170 may be thermally conductive and/or may be electrically conductive, such as to provide EMI shielding for the pluggable module 106. The pluggable body 170 includes a mating end 172 and an opposite front end 174. The mating end 172 is configured to be inserted into the corresponding module channel 116 (shown in FIG. 1). The front end 174 may be a cable end having a cable extending therefrom to another component within the system.

The pluggable module 106 includes a module circuit card 176 that is configured to be communicatively coupled to the card edge connector 112 (shown in FIG. 1). The module circuit card 176 may be accessible at the mating end 172. The module circuit card 176 has a card edge 178 extending between a first or upper surface and a second or lower surface at a mating end of the module circuit card 176. The module circuit card 176 includes card contacts 179, such as pads or circuits, at the card edge 178 configured to be mated with the card edge connector 112. In an exemplary embodiment, the card contacts 179 are provided on the upper surface and the lower surface. The module circuit card 176 may include components, circuits and the like used for operating and or using the pluggable module 106. For example, the module circuit card 176 may have conductors, traces, pads, electronics, sensors, controllers, switches, inputs, outputs, and the like associated with the module circuit card 176, which may be mounted to the module circuit card 176, to form various circuits.

The pluggable module 106 includes an outer perimeter defining an exterior of the pluggable body 170. For example, the outer perimeter may be defined by a top 180, a bottom 182, a first side 184 and a second side 186. The pluggable body 170 may have other shapes in alternative embodiments. In an exemplary embodiment, the pluggable body 170 provides heat transfer for the module circuit card 176, such as for the electronic components on the module circuit card 176. For example, the module circuit card 176 is in thermal communication with the pluggable body 170 and the pluggable body 170 transfers heat from the module circuit card 176. Optionally, the pluggable body 170 may include a plurality of heat transfer fins 188 along at least a portion of the outer perimeter, such as the top 180, of the pluggable module 106 for dissipating heat from the pluggable body 170.

In other various embodiments, the pluggable module 106 may be a circuit card rather than an I/O module. For example, the pluggable module 106 may include the module circuit card 176 without the pluggable body 170 surrounding the module circuit card 176.

Figure 3:
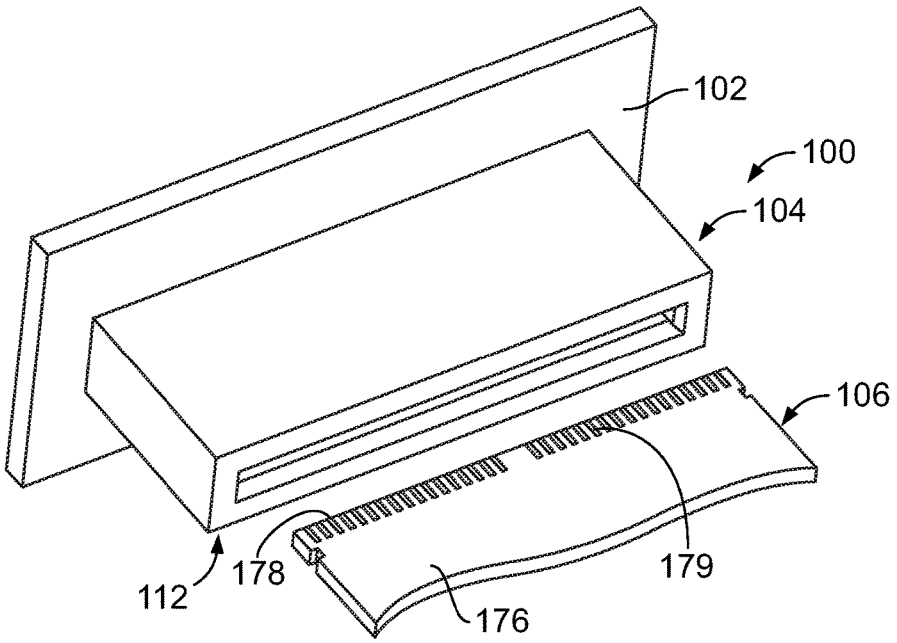
FIG. 3 is a front perspective view of the communication system in accordance with an exemplary embodiment.

FIG. 3 is a front perspective view of the communication system 100 in accordance with an exemplary embodiment. The receptacle connector assembly 104 is shown as an electrical connector 112, such as a card edge connector, mounted to the host circuit board 102 (without a receptacle cage). The card edge connector 112 may be mounted horizontally or vertically in various embodiments. The card edge connector 112 may be mounted to the circuit board 102 to receive the pluggable module 106 in a direction perpendicular to the circuit board 102 in various embodiments. In the illustrated embodiment, the receptacle connector assembly 104 is a pass-through connector having the mating end and the mounting end of the housing parallel to each other rather than perpendicular to each other such that the contacts pass straight through the housing rather than being right angle contacts. In alternative embodiments, the card edge connector 112 may be a right-angle card edge connector mounted to the circuit board 102 to receive the pluggable module 106 in a direction parallel to the circuit board 102.

In the illustrated embodiment, the pluggable module 106 includes the module circuit card 176 without the outer pluggable body (shown in FIG. 2) holding the module circuit card 176. The module circuit card 176 includes the card edge 178 between a first or upper surface and a second or lower surface at a mating end of the module circuit card 176. The module circuit card 176 includes the card contacts 179 at the card edge 178, such as at both the upper surface and the lower surface, configured to be mated with the contacts of the card edge connector 112.

Figure 4:
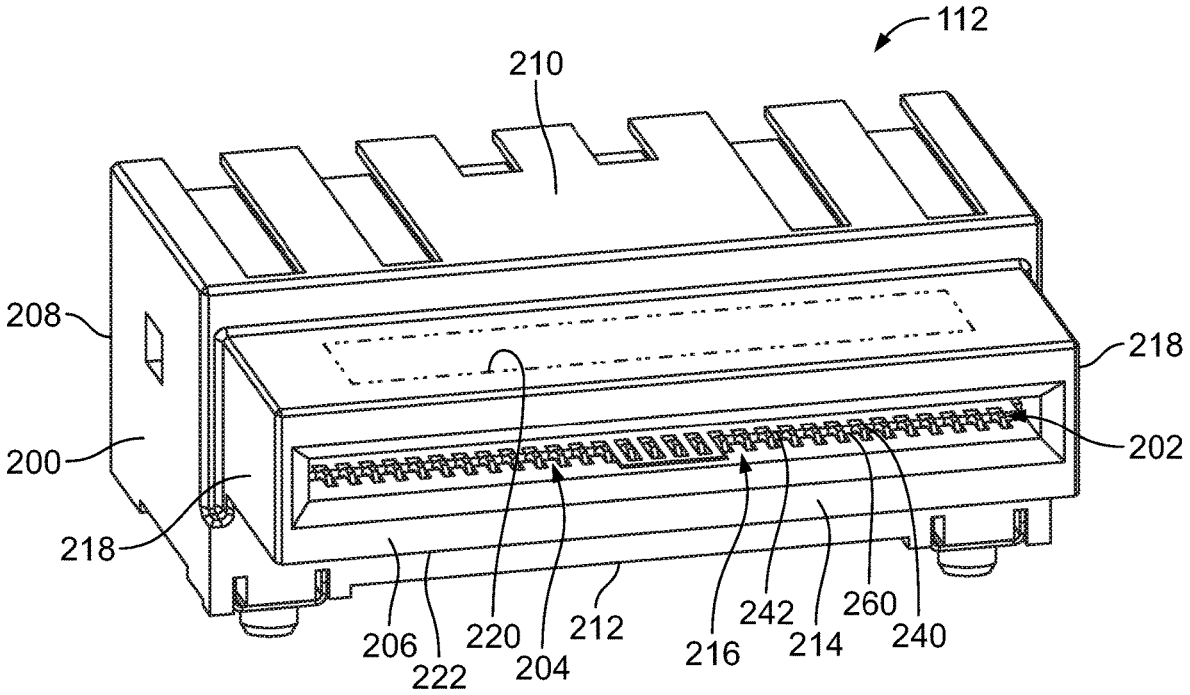
FIG. 4 is a front perspective view of the card edge connector in accordance with an exemplary embodiment.

FIG. 4 is a front perspective view of the card edge connector 112 in accordance with an exemplary embodiment. The card edge connector 112 includes a housing 200 and a contact assembly 202 received in a cavity 204 of the housing 200. The housing 200 extends between a front 206 and a rear 208. The housing 200 extends between a top 210 and a bottom 212. The housing 200 extends between opposite sides 218. The housing 200 may be generally box shaped in various embodiments. In the illustrated embodiment, the bottom 212 defines a mounting end configured to be mounted to the host circuit board 102 (shown in FIG. 1) and the front 206 defines the mating end configured to be mated with the pluggable module 106 (shown in FIG. 1). Other orientations are possible in alternative embodiments (for example, mating end at the top 210).

The housing 200 includes a top wall 220 at the top 210 and a bottom wall 222 at the bottom 212. In the illustrated embodiment, the housing 200 includes a shroud 214 at the front 206 configured to be mated with the pluggable module 106. The shroud 214 is configured to be received in the pluggable module 106. The housing 200 includes a housing card slot 216 at the front 206. For example, the housing card slot 216 may be located in the shroud 214 and open at the front of the shroud 214. The housing card slot 216 receives the card edge 178 (shown in FIG. 2) of the module circuit card 176 (shown in FIG. 2).

In an exemplary embodiment, the contact assembly 202 is a double-sided contact assembly. For example, the contact assembly 202 includes upper contacts 240 arranged in an upper contact array 242 and lower contacts 260 arranged in a lower contact array 242. The upper contacts 240 and the lower contacts 260 are on opposite sides of the card slot 216. The upper contacts 240 are arranged in an upper row and the lower contacts 260 are arranged in a lower row. The upper contacts 240 may be arranged in multiple rows and/or the lower contacts 260 may be arranged in multiple rows. The card edge connector 112 has high density and significant data throughput.

Figure 5:
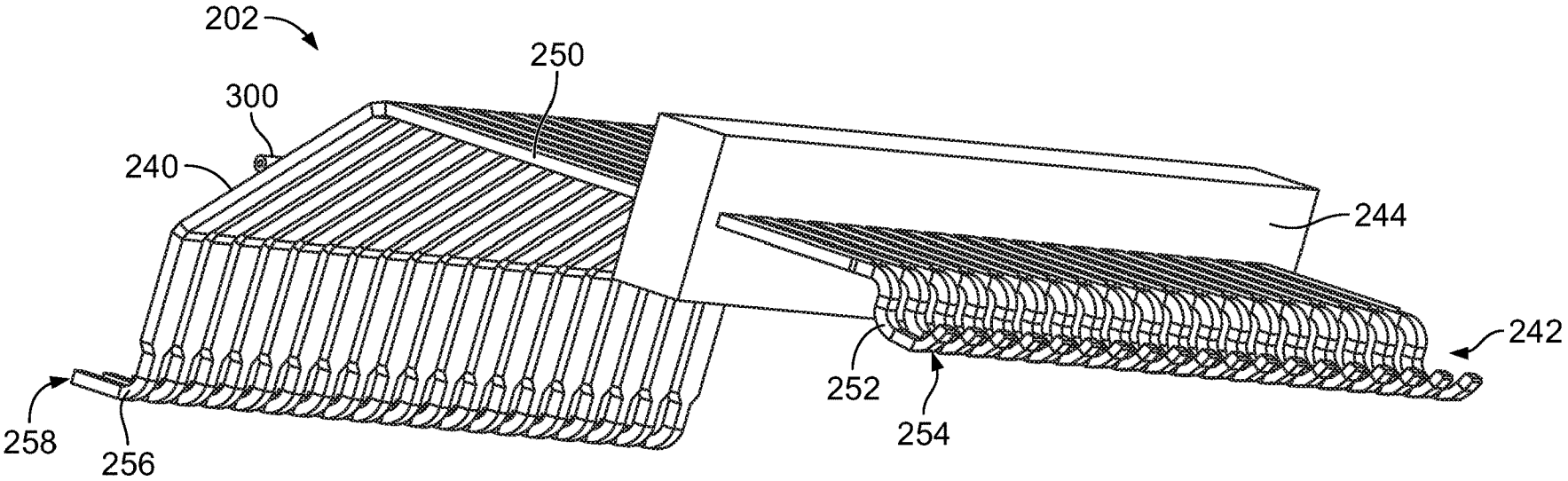
FIG. 5 is a front perspective view of a portion of the contact assembly showing the upper contact array in accordance with an exemplary embodiment.

FIG. 5 is a front perspective view of a portion of the contact assembly 202 showing the upper contact array 242. In an exemplary embodiment, the contact assembly 202 includes one or more ground bus wires 300 extending transversely across the upper contact array 242. The ground bus wire(s) 300 are configured to be electrically connected to each of the ground contacts of the upper contact array 242 to electrically connect the ground contacts. The ground bus wire(s) 300 are configured to be electrically isolated from the signal contacts of the upper contact array 242.

In an exemplary embodiment, the upper contact array 242 is formed from a leadframe, such as being stamped and formed. The contact array 242 includes a contact holder 244 holding the upper contacts 240. The contact holder 244 may hold all of the upper contacts 240 relative to each other, such as to hold a spacing between the upper contacts 240. Optionally, multiple contact holders 244 may be provided, such as proximate to the front and proximate to the rear of the upper contact array 242. The contact holder 244 is manufactured from a dielectric material, such as a plastic material. For example, the contact holder 244 may be overmolded over the upper contacts 240.

Each upper contact 240 includes a transition portion 250 extending between a mating beam 252 at a mating end 254 of the upper contact 240 and a contact tail 256 at a terminating end or mounting end 258 of the upper contact 240. The mating end 254 is configured to be mated to the mating electrical connector 106 (shown in FIG. 1), such as to the module circuit card 176 (shown in FIG. 2) of the pluggable module 106. For example, the mating beam 252 may be a deflectable mating beam having a separable mating interface. The mounting end 258 is configured to be electrically connected to the host circuit board 102 (shown in FIG. 1). For example, the contact tail 256 may be a solder tail configured to be soldered to the host circuit board 102. The contact tail 256 may be a press-fit tail in alternative embodiments. In an exemplary embodiment, the contact holder 244 is connected to and supports the mating beams 252 of the upper contacts 240. For example, the mating beams 252 extend forward of the contact holder 244. The transition portions 250 extend rearward of the contact holder 244. Optionally, portions of the mating beams 252 and/or front portions of the transition portions 250 may be encased in the front contact holder 244.

The transition portions 250 transition between the mating ends 254 and the mounting ends 258. In an exemplary embodiment, the mating ends 254 and the mounting ends 258 are oriented generally perpendicular to each other. For example, the contact assembly 202 is a right angle contact assembly. The transition portions 250 include one or more bends to transition between the mating ends 254 and the mounting ends 258. The transition portions 250 may be bent along various sections to transition between the mating and mounting ends 254, 258.

Various upper contacts 240 may be signal contacts and other upper contacts 240 may be ground contacts, such as interspersed between signal contacts or pairs of signal contacts. In an exemplary embodiment, the upper contacts 240 are flexible and configured to be elastically deformed and flexed, such as during assembly and during mating with the module circuit card 176. The mating beams 252 may be cantilevered spring beams extending forward from the front contact holder 244 configured to be flexed when mated with the module circuit card 176. The contact tails 256 may be flexed when mounted to the host circuit board 102.

Figure 6:
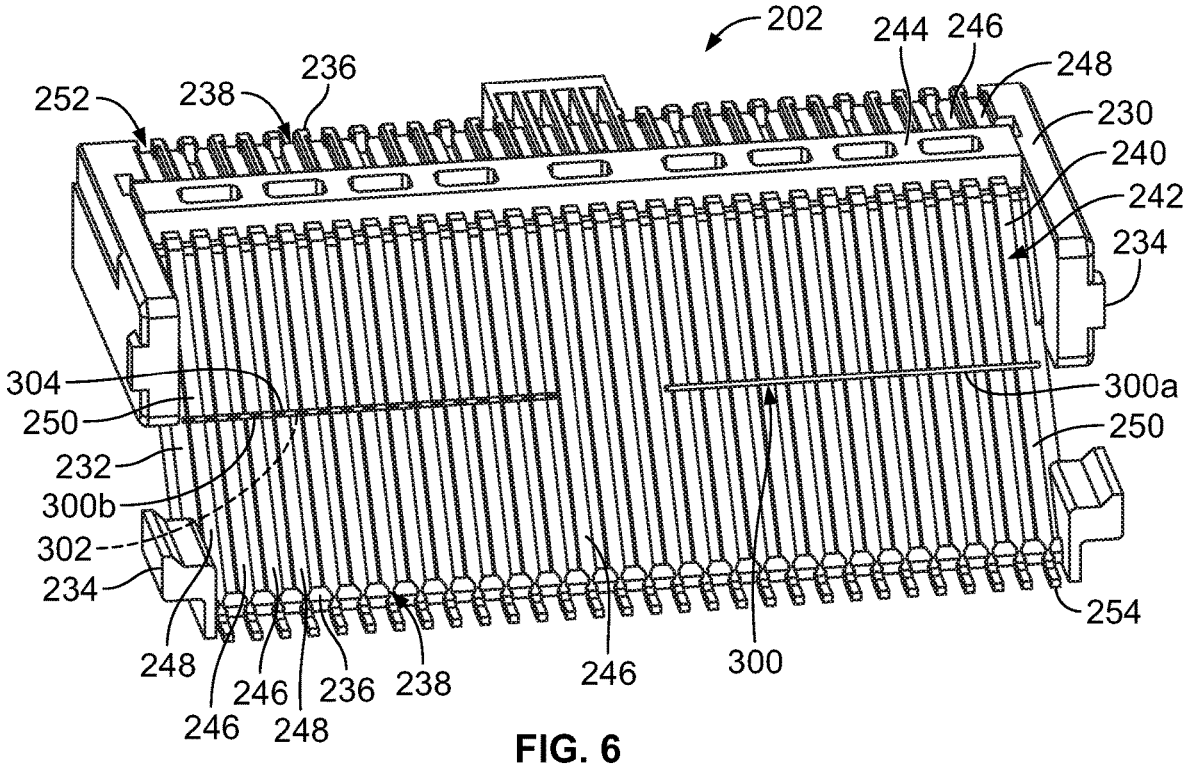
FIG. 6 is a rear perspective view of a portion of the contact assembly in accordance with an exemplary embodiment.
Figure 7:
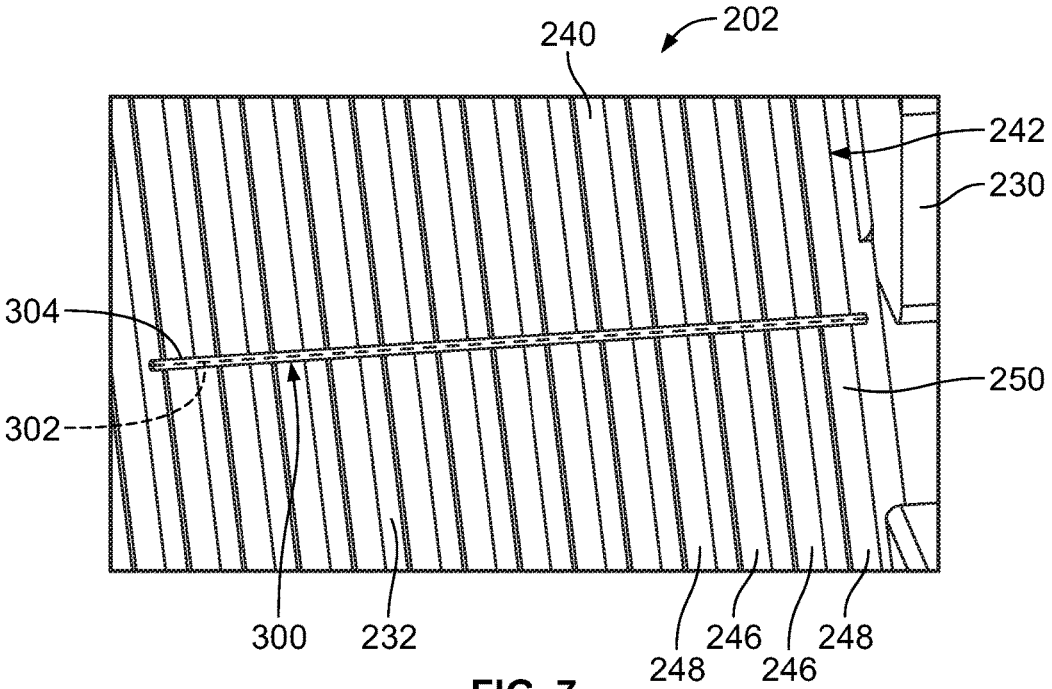
FIG. 7 is an enlarged view of a portion of the contact assembly in accordance with an exemplary embodiment.

FIG. 6 is a rear perspective view of a portion of the contact assembly 202 in accordance with an exemplary embodiment. FIG. 7 is an enlarged view of a portion of the contact assembly 202 in accordance with an exemplary embodiment. FIG. 6 shows the upper contact array 242 and corresponding contact holder 244 coupled to a contact positioner 230 of the contact assembly 202. The contact holder 244 is coupled to the contact positioner 230 to position the upper contacts 240 relative to the contact positioner 230. The contact positioner 230 may additionally hold the lower contact array 266 (not shown). The contact positioner 230 is configured to be loaded into the cavity 204 of the housing 200 (shown in FIG. 4) to position the upper contacts 240 (and the lower contacts 260) in the housing 200. The contact positioner 230 is used to position the upper and lower contacts 240, 260 relative to each other.

The contact positioner 230 includes a base 232 supporting the upper contacts 240 and locating features 234 extending from the base 232 for locating the contact positioner 230 in the housing 200. In the illustrated embodiment, the locating features 234 may be tabs or rails configured to be loaded into slots or grooves in the housing 200. Other types of locating features 234 may be used in alternative embodiments, such as posts, pins, slots, channels, and the like. The base 232 may hold the lower contacts 260 in addition to the upper contacts 240. For example, the base 232 may hold the upper contacts 240 on an upper surface of the base 232 and may hold the lower contacts 260 on a lower surface of the base 232. In an exemplary embodiment, the contact positioner 230 includes contact support walls 236 configured to support the contacts, such as the upper contacts 240 (or the lower contacts 260). In the illustrated embodiment, the contact support walls 236 extend from the base 232. The contact support walls 236 form contact channels 238 receiving the corresponding contacts 240, 260. The contacts 240, 260 may be held in the contact channels 238 by the contact support walls 236, such as by an interference fit.

In an exemplary embodiment, the upper contacts 240 include signal contacts 246 and ground contacts 248. The signal contacts 246 may include high speed signal contacts and/or low speed signal contacts. The high speed signal contacts may be arranged in pairs and the low speed signal contacts may be single ended contacts. The ground contacts 248 are interspersed between the signal contacts 246, such as between the pairs of the signal contacts 246. In an exemplary embodiment, the ground contacts 248 are shaped identical to the signal contacts 246.

The ground bus wire 300 extends transversely across the upper contact array 242. Optionally, multiple ground bus wires 300 may be provided. The ground bus wire 300 is electrically connected to each of the ground contacts 248 that the ground bus wire 300 extends across. Optionally, the ground bus wire 300 may be electrically connected to each and every ground contact 248 in the upper contact array 242, such as when the ground bus wire 300 extends across the entire upper contact array 242. In an exemplary embodiment, the ground bus wire extends perpendicular to the transition portions 250, such as side-to-side across the contact assembly 202. The ground bus wire 300 is electrically connected to the transition portions 250 of each of the ground contacts 248. The ground bus wire 300 is configured to be in physical contact with the signal contacts 246 without being electrically connected to the signal contacts 246. In an exemplary embodiment, the transition portions 250 of the signal contacts 246 are coplanar with the transition portions 250 of the ground contacts 248 and the ground bus wire 300 lays across both the transition portions 250 of the signal contacts 246 and the transition portions 250 of the ground contacts 248.

In various embodiments, the contact assembly 202 includes two ground bus wires 300 extending across the upper contact array 242, such as a right side ground bus wire 300*a* and a left side ground bus wire 300*b*. The right and left side ground bus wires 300*a*, 300*b* are separate and discrete from each other with a space or gap therebetween, the gap being aligned with the low speed signal contacts. The right side ground bus wire 300*a* spans across corresponding high speed signal contacts 246 and ground contacts 248 at the right side of the upper contact array 242 and the left side ground bus wire 300*b* spans across corresponding high speed signal contacts 246 and ground contacts 248 at the left side of the upper contact array 242. The right side ground bus wire 300*a* is electrically connected to the ground contacts 248 at the right side of the upper contact array 242 and the left side ground bus wire 300*b* is electrically connected to the ground contacts 248 at the left side of the upper contact array 242.

In an exemplary embodiment, the ground bus wire 300 is a cylindrical wire. The ground bus wire 300 may have a diameter less than a width of the ground contacts 248. The ground bus wire 300 includes a center conductor 302 (shown in phantom in FIGS. 6 and 7) and an outer insulator 304 surrounding the conductor 302. The insulator 304 electrically isolates the conductor 302 from the signal contacts 246. In an exemplary embodiment, portions of the insulator 304 are removed to expose the conductor 302 for electrical connection with the ground contacts 248. For example, the insulator 304 may include windows 306 (shown in FIG. 9) exposing the conductor 302, which are aligned with the ground contacts 248 to allow the conductor to be electrically connected to the ground contacts 248. Covered portions of the conductors 302 may be referred to as insulated segments. Uncovered portions of the conductors 302 may be referred to as exposed segments or attachment segments, which are configured to be electrically connected to the ground contacts 248.

In an exemplary embodiment, the ground bus wire 300 is a high resistance wire, such as a coated high resistance wire. For example, the ground bus wire 300 may be an enamel coated wire. The enamel coating forms the insulator 304. The coating may be removed at select areas to form the windows 306 for connection of the conductor 302 to the ground contacts 248.

In an exemplary embodiment, the ground bus wire 300 is configured to be soldered or welded to each of the ground contacts 248. The conductor 302 is soldered or welded to the ground contacts 248 to electrically connect the ground bus wire 300 to the ground contacts 248. Optionally, the insulator 304 is removed during the soldering or welding process to expose the conductor 302 for electrical connection with the ground contacts 248. For example, the heat from the welding or soldering process may melt away the insulator 304, such as the coating.

Figure 8:
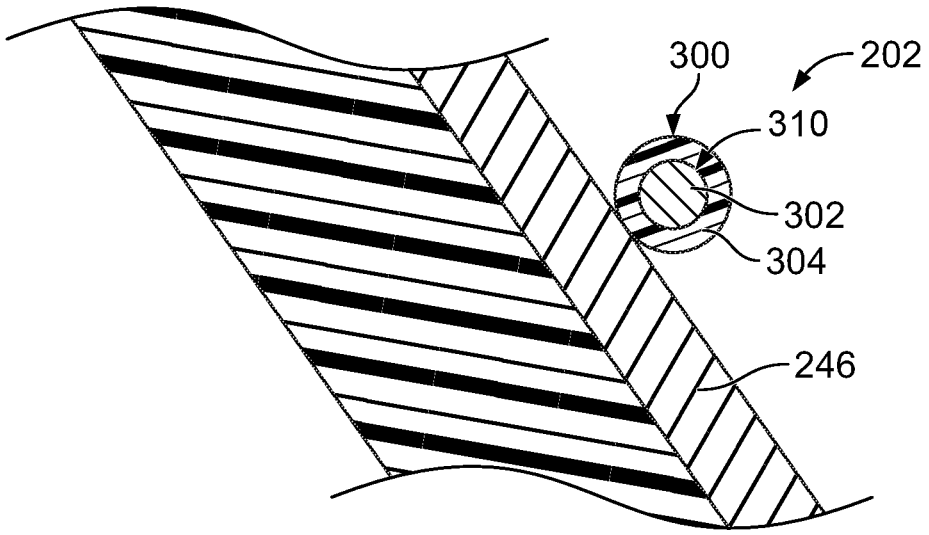
FIG. 8 is a cross sectional view of a portion of the contact assembly showing the ground bus wire extending across the signal contact in accordance with an exemplary embodiment.
Figure 9:
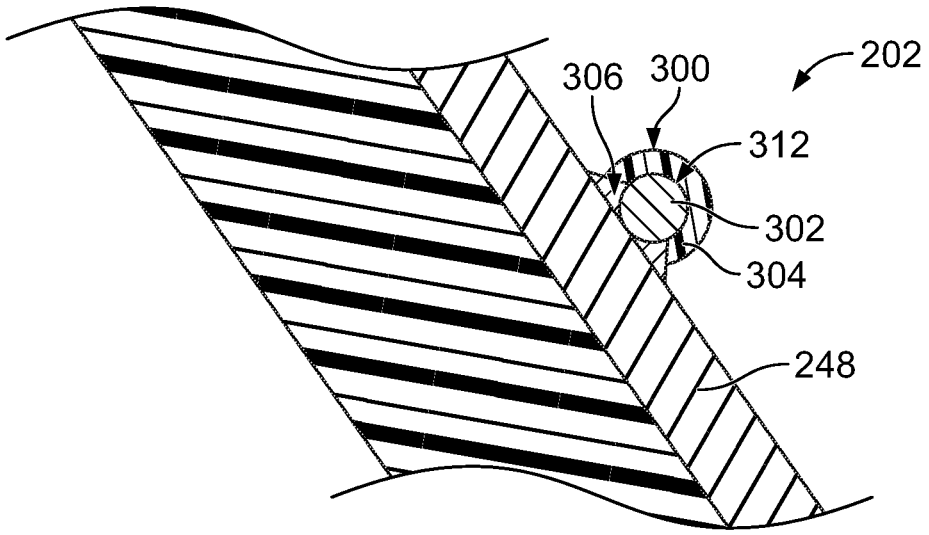
FIG. 9 is a cross sectional view of a portion of the contact assembly showing the ground bus wire extending across the ground contact in accordance with an exemplary embodiment.

FIG. 8 is a cross sectional view of a portion of the contact assembly 202 showing the ground bus wire 300 extending across the signal contact 246. FIG. 9 is a cross sectional view of a portion of the contact assembly 202 showing the ground bus wire 300 extending across the ground contact 248. FIG. 8 shows an insulated segment 310 of the conductor 302, which is surrounded by the insulator 304. The insulator 304 electrically isolates the conductor 302 from the signal contact 246. FIG. 9 shows an attachment segment 312 of the conductor 302, which is exposed by the window 306 for electrical connection to the ground contact 248. The attachment segment may be soldered or welded to the ground contact 248. The ground bus wire 300 includes a series of insulated segments 310 and attachment segments 312 interspersed along the length of the ground bus wire 300. The insulated segments 310 and the attachment segments 312 are arranged such that the insulated segments 310 span across each of the signal contacts 246 and the attachment segments 312 span across each of the ground contacts 248.

Figure 10:
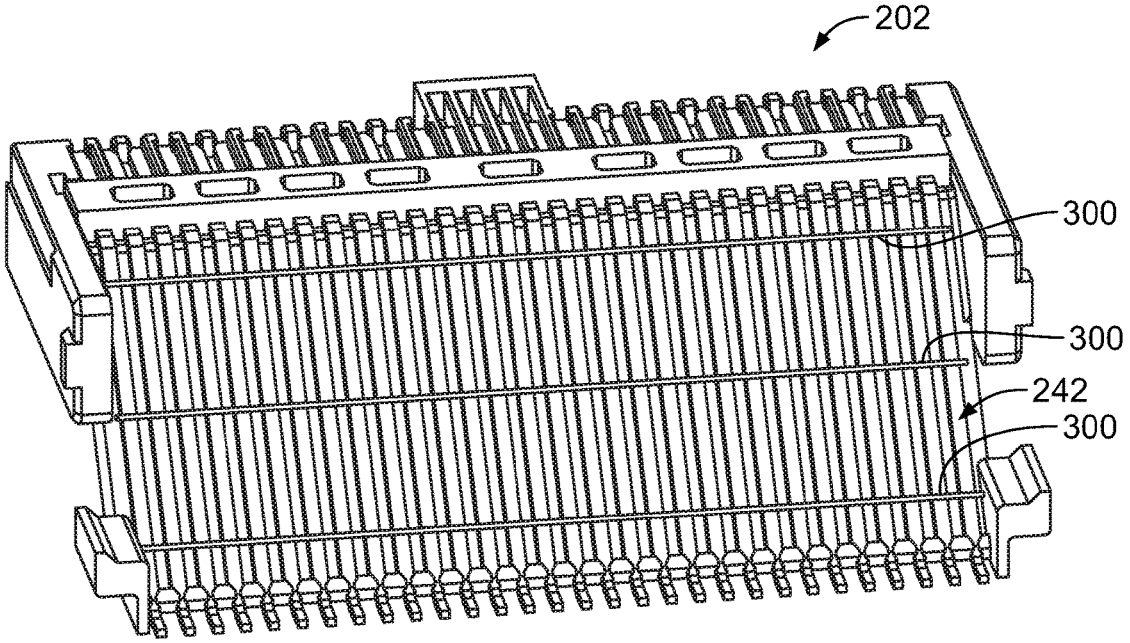
FIG. 10 is a rear perspective view of a portion of the contact assembly 202 in accordance with an exemplary embodiment.

FIG. 10 is a rear perspective view of a portion of the contact assembly 202 in accordance with an exemplary embodiment. FIG. 10 shows the contact assembly 202 with a plurality of the ground bus wires 300. The ground bus wires 300 extending transversely across the contact array 242. The ground bus wires 300 extend parallel to each other, extending side-to-side across the contact array 242. The ground bus wires 300 may be approximately equally spaced apart. Spacing between the ground bus wires 300 may be selected to control impedance.

Figure 11:
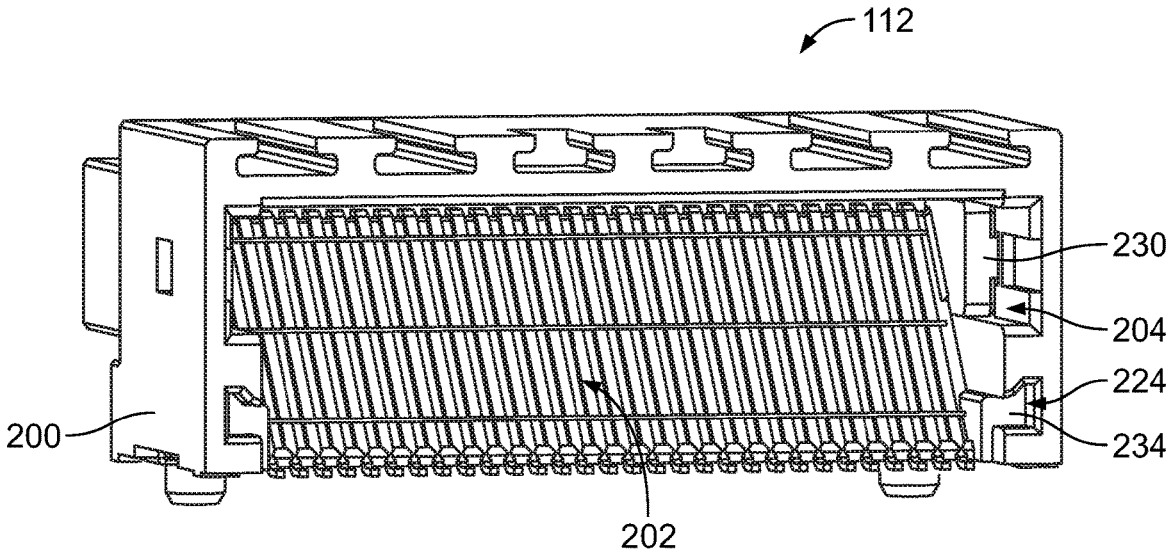
FIG. 11 is a rear perspective view of a portion of the electrical connector in accordance with an exemplary embodiment.

FIG. 11 is a rear perspective view of a portion of the electrical connector 112 in accordance with an exemplary embodiment. FIG. 11 shows the contact assembly 202 loaded in the cavity 204 of the housing 200. The housing 200 includes guide slots 224 that receive the locating features 234 of the contact positioner 230.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A contact assembly for an electrical connector comprising:

a contact positioner having contact support walls;

a contact array including signal contacts and ground contacts interspersed with the signal contacts, the signal contacts and the ground contacts being held by the support walls of the contact positioner, the signal contacts including mating ends configured to be mated with a mating electrical connector and mounting ends configured to be terminated to a host circuit board, the signal contacts including transition portions between the mating ends and the mounting ends, the ground contacts including mating ends configured to be mated with the mating electrical connector and mounting ends configured to be terminated to the host circuit board, the ground contacts including transition portions between the mating ends and the mounting ends; and a ground bus wire extending transversely across the contact array, the ground bus wire being electrically connected to each of the ground contacts, the ground bus wire being electrically isolated from each of the signal contacts, the ground bus wire being in physical contact with the signal contacts without being electrically connected to the signal contacts.

2. The contact assembly of claim 1, wherein the ground bus wire is electrically connected to the transition portions of each of the ground contacts.

3. The contact assembly of claim 1, wherein the ground bus wire is a cylindrical wire having a diameter less than a width of the ground contacts.

4. The contact assembly of claim 1, wherein the ground bus wire extends perpendicular to the transition portions.

5. The contact assembly of claim 1, wherein the ground bus wire includes a conductor and an insulator surrounding the conductor, the insulator electrically isolating the conductor from the signal contacts.

6. The contact assembly of claim 1, wherein the ground bus wire includes a conductor and an insulator surrounding the conductor, the insulator including windows exposing the conductor, the windows being aligned with the ground contacts to electrically connect the conductor to the ground contacts.

7. The contact assembly of claim 1, wherein the ground bus wire includes a conductor and an insulator surrounding the conductor, the conductor including insulated segments and attachment segments interspersed with the insulated segments along a length of the ground bus wire, the ground bus wire extending across the contact array such that the insulated segments span across the signal contacts and the attachment segments span across the ground contacts, the ground contacts being electrically connected to the attachment segments.

8. The contact assembly of claim 1, wherein the ground bus wire is a coated high resistance wire.

9. The contact assembly of claim 1, wherein the ground bus wire is an enamel coated wire, wherein enamel coating of the enamel coated wire is removed at select areas for connection to the ground contacts.

10. The contact assembly of claim 1, wherein the ground bus wire is one of soldered or welded to each of the ground contacts.

11. The contact assembly of claim 10, wherein an insulator of the ground bus wire is removed during the soldering or welding process to expose a conductor of the ground bus wire for electrical connection with the ground contacts.

12. The contact assembly of claim 1, wherein the transition portions of the signal contacts are coplanar with the transition portions of the ground contacts, the ground bus wire laying across the transition portions of the signal contacts and the transition portions of the ground contacts.

13. The contact assembly of claim 1, further comprising a second ground bus wire extending transversely across the contact array parallel to the ground bus wire and spaced apart from the ground bus wire.

14. The contact assembly of claim 13, further comprising a third ground bus wire extending transversely across the contact array parallel to the second ground bus wire, the second ground bus wire being centered between the ground bus wire and the third ground bus wire.

15. An electrical connector for mating with a pluggable module, the electrical connector comprising:

a housing including a top and a bottom, the housing having a front and a rear, the housing having a first side and a second side, the bottom configured to be mounted to a host circuit board, the housing including a cavity and a housing card slot open to the cavity at the front of the housing, the housing card slot configured to receive a card edge of a module circuit card of the pluggable module; and a contact assembly received in the cavity, the contact assembly having a contact positioner having contact support walls supporting a contact array including signal contacts and ground contacts interspersed with the signal contacts, the signal contacts including mating ends configured to be mated with the module circuit card of the pluggable module and mounting ends configured to be terminated to the host circuit board, the signal contacts including transition portions between the mating ends and the mounting ends, the ground contacts including mating ends configured to be mated with the module circuit card of the pluggable module and mounting ends configured to be terminated to the host circuit board, the ground contacts including transition portions between the mating ends and the mounting ends, the contact assembly including a ground bus wire extending transversely across the contact array, the ground bus wire including a conductor and an insulator surrounding the conductor, the conductor of the ground bus wire being electrically connected to each of the ground contacts, the insulator of the ground bus wire electrically isolating the conductor from each of the signal contacts.

16. The card edge connector of claim 15, wherein the ground bus wire is in physical contact with the signal contacts without being electrically connected to the signal contacts.

17. The card edge connector of claim 15, further comprising a second ground bus wire extending transversely across the contact array parallel to the ground bus wire and spaced apart from the ground bus wire.

18. A communication system comprising:

a host circuit board including board contacts;

a pluggable module including a module circuit card, the module circuit card having a card edge, the module circuit card including card contacts proximate to the card edge; and an electrical connector mounted to the host circuit board, the electrical connector being electrically connected to the pluggable module to connect the pluggable module and the host circuit board, the electrical connector including a housing having a cavity and a contact assembly received in the cavity, the housing having a housing card slot receiving the card edge of the module circuit card of the pluggable module, the contact assembly having a contact positioner supporting a contact array including signal contacts and ground contacts interspersed with the signal contacts, the signal contacts including mating ends mated with the card contacts of the module circuit card and mounting ends terminated to the host circuit board, the signal contacts including transition portions between the mating ends and the mounting ends, the ground contacts including mating ends mated with the card contacts of the module circuit card and mounting ends terminated to the host circuit board, the ground contacts including transition portions between the mating ends and the mounting ends, the contact assembly including a ground bus wire extending transversely across the contact array, the ground bus wire being electrically connected to each of the ground contacts, the ground bus wire being electrically isolated from each of the signal contacts, the ground bus wire being in physical contact with the signal contacts without being electrically connected to the signal contacts.

19. The communication system of claim 1, wherein the ground bus wire includes a conductor and an insulator surrounding the conductor, the insulator electrically isolating the conductor from the signal contacts.

20. The communication system of claim 1, wherein the ground bus wire is a coated high resistance wire.

* * * * *